US005413191A

United States Patent [19]

Kerr

[11] Patent Number: 5,413,191

[45] Date of Patent: May 9, 1995

[54] DUAL TRACK LADDER

[75] Inventor: James F. Kerr, Croswell, Mich.

[73] Assignee: Material Control, Inc., Croswell, Mich.

[21] Appl. No.: 298,531

[22] Filed: Aug. 29, 1994

Related U.S. Application Data

[63] Continuation of Ser. No. 204,105, Mar. 1, 1994, abandoned, which is a continuation of Ser. No. 63,409, May 18, 1993, abandoned.

[51] Int. Cl.[6] ..... E06C 1/397

[52] U.S. Cl. ..... 182/39; 182/36

[58] Field of Search ..... 182/36–39, 182/150; 104/91, 93

[56] References Cited

U.S. PATENT DOCUMENTS

| | | | |
|---|---|---|---|
| 356,375 | 1/1887 | Perkins . | |
| 470,374 | 3/1892 | Fisher . | |
| 528,824 | 11/1894 | Sumner . | |
| 775,488 | 11/1904 | Tefzlaff | 182/39 |
| 907,401 | 12/1908 | Prouty . | |
| 1,320,740 | 11/1919 | Coghlin . | |
| 1,341,996 | 6/1920 | Plucienski . | |
| 2,273,124 | 2/1942 | McDaniels | 182/39 |
| 5,148,889 | 9/1992 | Fenwick et al. . | |

FOREIGN PATENT DOCUMENTS 832727 10/1938 France .

OTHER PUBLICATIONS

Lista, Sets the Standard for Systematic Storage, "Storage Wall System," Catalog SW-255 Cotterman, Rolling Wood Ladders, Bulletin WL-188.

*Primary Examiner*—Alvin C. Chin-Shue
*Attorney, Agent, or Firm*—Dykema Gossett

[57] ABSTRACT

A ladder system is disposed between two spaced storage shelves. The ladder may move longitudinally along the shelves, and may also be moved laterally between the shelves. Further, the ladder may pivot about a lateral axis such that the ladder may be picked up over obstructions in an aisle between the shelves. In this way, one can quickly and easily position the ladder at any position along or between the two storage shelves for accessing items stored on the shelves. This ladder system is particularly useful in the crowded warehouse-type retail outlets which are now gaining popularity.

5 Claims, 3 Drawing Sheets

DUAL TRACK LADDER

This is a continuation of application Ser. No. 08/204,105, filed on Mar. 1, 1994, now abandoned, which is a continuation of patent application of Ser. No. 08/063,409, filed on May 18, 1993, now abandoned.

BACKGROUND OF THE INVENTION

This application in general relates to a ladder system for use with a pair of spaced storage shelves.

In the prior art, many warehouses have crowded storage shelves spaced by a narrow aisle. It is common that items may be stored in the aisle. It is desirable to provide a ladder to access items stored on those shelves.

One prior art ladder is mounted on rollers for movement along the aisle. While this type of ladder has benefits in some applications, if there are obstructive items stored on the floor of the aisle, the ladder may not always be able to pass around the items.

Another type of prior art system is a "library-type" ladder which is mounted for movement longitudinally along one of the shelves. Again, if obstructive items are stored in the way of the ladder, the ladder may not be able to move around the obstruction. Further, this type of ladder requires a single ladder unit for each of the two spaced storage shelves.

SUMMARY OF THE INVENTION

In a disclosed embodiment of this invention, a ladder is mounted for longitudinal movement along a pair of spaced storage shelves. Further, the ladder preferably moves laterally between the shelves, and may also pivot about a lateral axis. One may thus position the ladder laterally adjacent either of the shelves and at any longitudinal location along the shelves. Should an obstruction be encountered, the ladder may pivot upwardly and over that obstruction. Further, the ability to pivot the ladder facilitates the movement of the ladder longitudinally and laterally along and between the shelves.

In a preferred embodiment of this invention, a mount structure includes a pair of spaced sidewalls. Each sidewall is received on a guide track mounted to one of the spaced storage shelves. A rod extends between the sidewalls, and the ladder is mounted on the rod. The sidewalls are mounted for longitudinal movement along the guide tracks mounted on the storage shelves. The ladder includes a pair of spaced rollers mounted on the rod such that the ladder may roll laterally along the rod, and may also pivot on the rod. To this end, the rollers include curved inward faces which correspond to the outer periphery of the rod, and allow the ladder to roll and pivot on the rod. Further, the mount structure for mounting the sidewall on the guide track includes a pair of spaced rollers which also conform to the shape of the guide track.

In a method of using the present invention, one rolls the ladder longitudinally along the shelves until one reaches a location which corresponds to an item one wishes to remove from the shelves. The ladder may be moved laterally to go around obstructions, or to position the ladder adjacent a particular shelf. Finally, the ladder may be pivoted to move over an obstruction, or to facilitate movement of the ladder.

These and other features of the present invention can be best understood from the following specification and drawings.

DETAILED DESCRIPTION OF A PREFERRED EMBODIMENT

Figure 1:
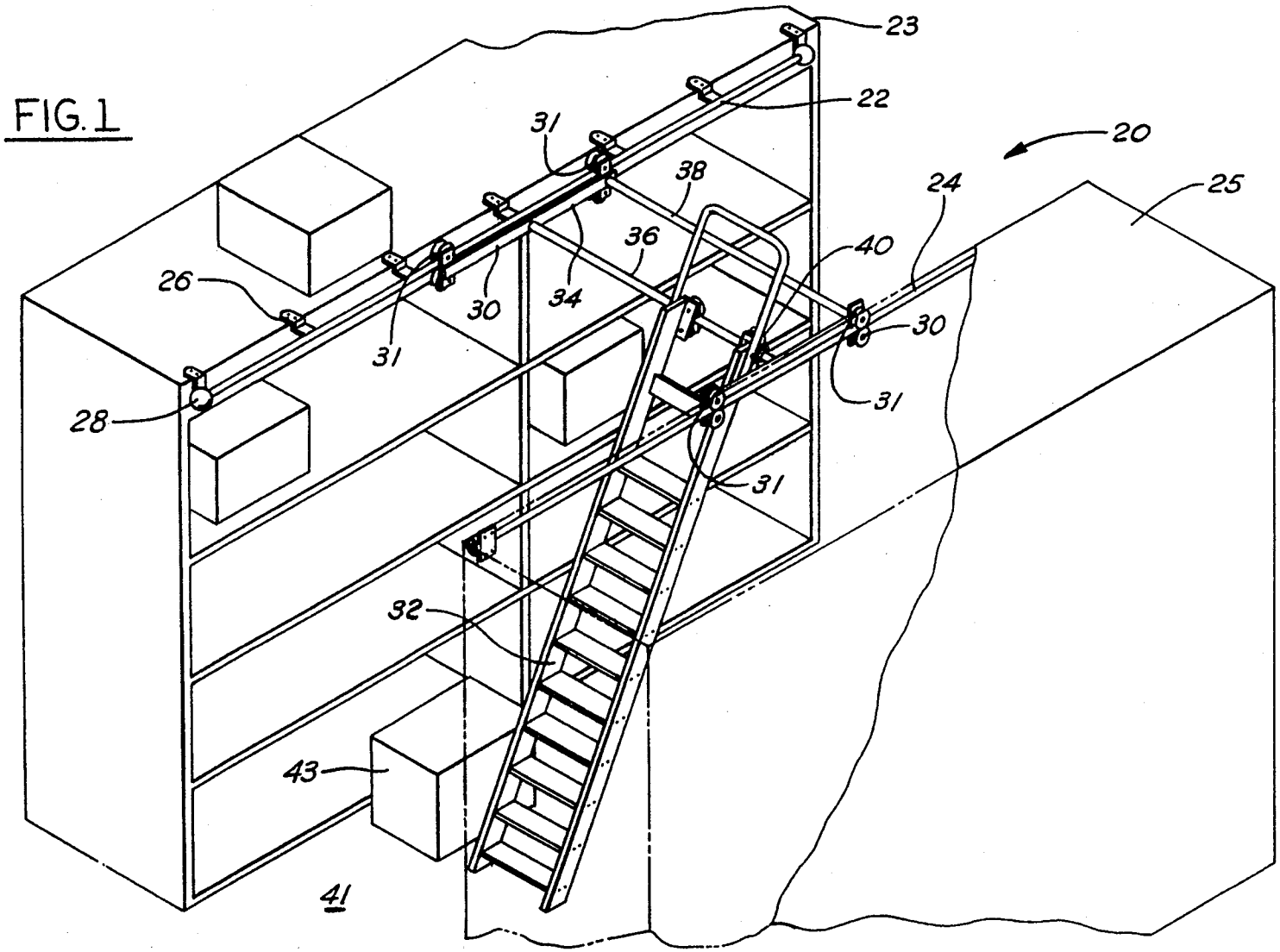
FIG. 1 is a partially cutaway perspective view of a ladder system constructed according to the present invention.

FIG. 1 shows a ladder system 20 including a first guide track 22 mounted on a shelving unit 23 and a second guide track 24 mounted on a shelving unit 25. The guide tracks 22 and 24 are mounted through a plurality of brackets 26 to the shelving units 23 and 25, and at their ends by end mounts 28.

A roller structure 30 is mounted for longitudinal movement along guide tracks 22 and 24. As shown, roller structure 30 includes sidewalls 34 associated with each guide track, and a pair of laterally extending rods 36 and 38. Each sidewall 34 receives a pair of roller sets 31 which include a pair of rollers on both sides of tracks 22 and 24. Ladder 32 is mounted by a pair of laterally spaced roller sets 40 on rod 36. As shown, an aisle 41 is defined between shelving units 23 and 25. Ladder 32 and roller structures 30 may move longitudinally along the shelves 23 and 25 on tracks 22 and 24. Ladder 32 may move independent of roller structure 30 laterally between the shelves, and may also pivot about rod 36. This facilitates movement of the ladder 32 to any location laterally or longitudinally within the aisle 41, and further facilitates the movement of the ladder 32 above and over items such as obstruction 43 which may be found in aisle 41.

Figure 2:
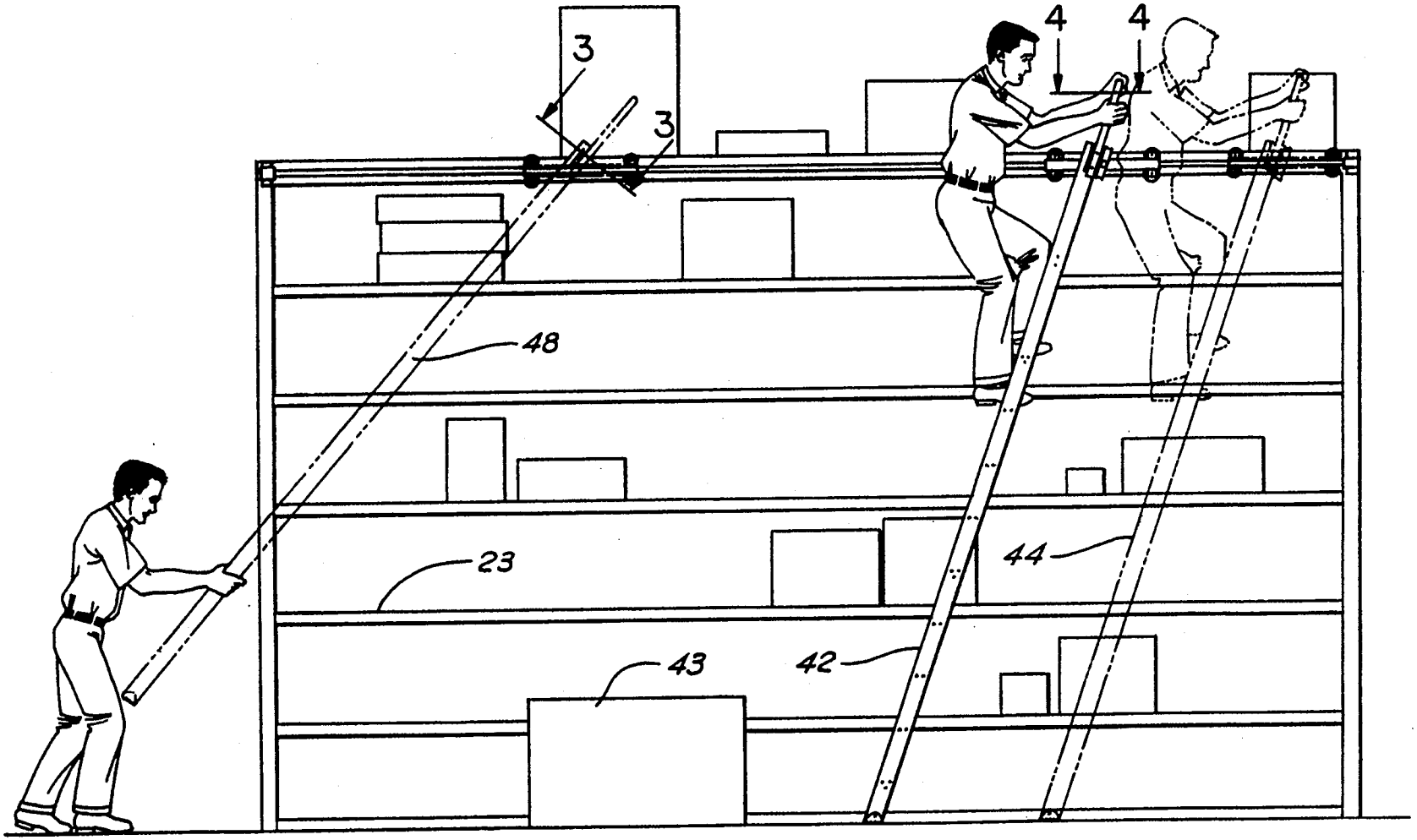
FIG. 2 is a side view showing use of the inventive ladder system.

As shown in FIG. 2, ladder 32 is in a first longitudinal position 42 relative to shelving unit 23. Should one desire to reach an item which is positioned longitudinally further along shelving unit 23, one may easily move the ladder 32 to position 44. Also, if one would desire to move the ladder 32 to a longitudinal position at the opposed end of shelving unit 23, the ladder 32 may be pivoted as shown at 48 such that it moves above and over obstruction 43.

Figure 3:
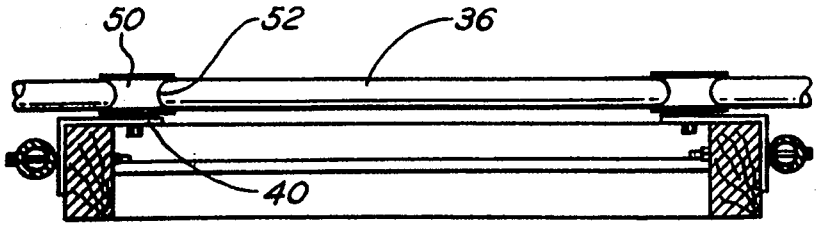
FIG. 3 is a view, partly in section, taken along line 3—3 of FIG. 2.

As shown in FIG. 3, rod 36 has a circular cross section. Roller sets 40 include a pair of rollers 50, only one of which is shown in this figure, having a curved inner face 52 corresponding to the outer periphery of rod 36. In this way, the rollers 50 may roll laterally along rod 36, but may also pivot about rod 36.

Figure 4:
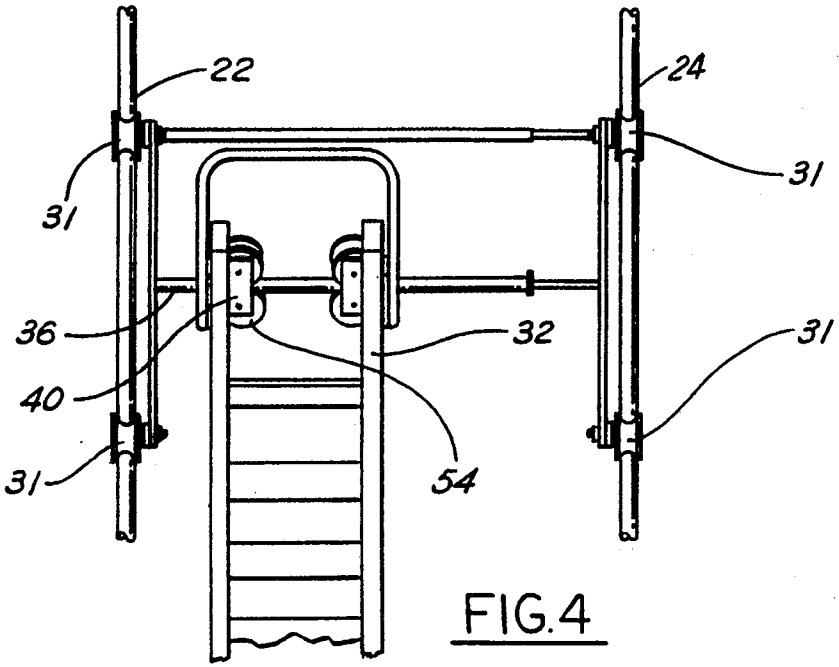
FIG. 4 is a fragmentary view taken along line 4—4 of FIG. 2.

As shown in FIG. 4, the roller sets 31 also have a curved inner periphery for rolling along guide tracks 22 and 24. Also as shown there are a pair of rollers 50 and 54 spaced on each side of rod 36. As explained with reference to FIG. 3, the shape of the inner faces of rollers 50 and 54 allow the ladder 32 to pivot about rod 36.

Figure 5:
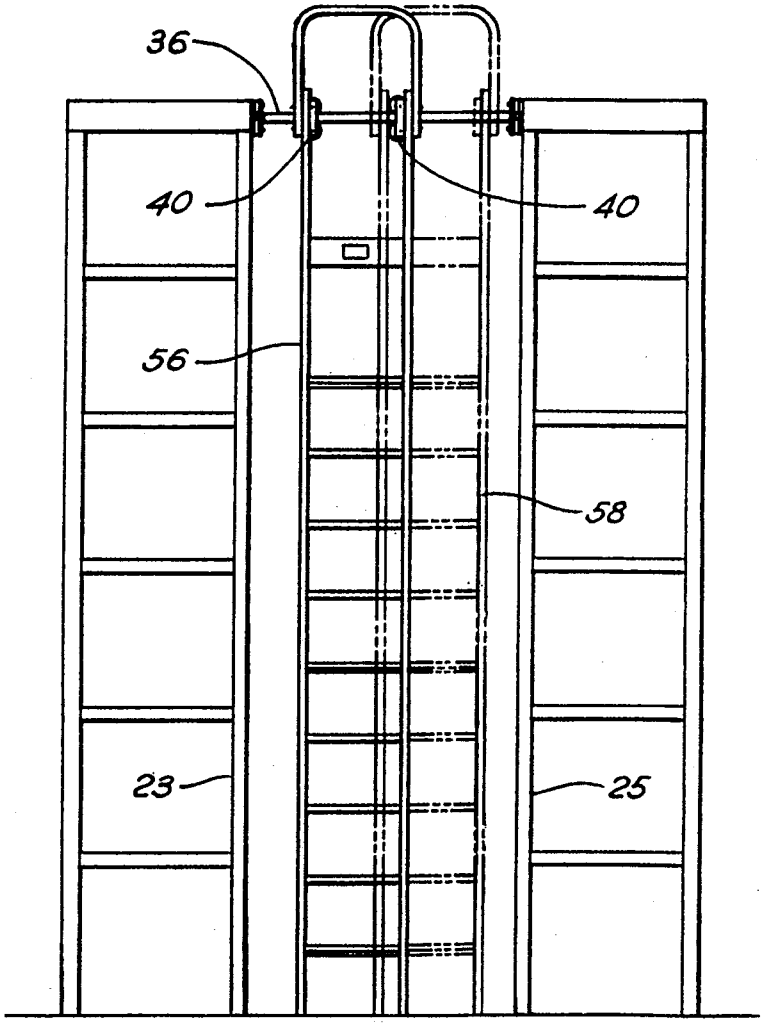
FIG. 5 is an end view of the ladder system according to the present invention.

As shown in FIG. 5, the ladder 32 may be initially positioned in position 56 adjacent to shelving unit 23, but may be moved laterally to a position 58 more adjacent to shelving unit 25. As can be appreciated, this ability to move the ladder 32 improves its usefulness since it can be positioned in any location laterally between the shelving units 23 and 25.

A particular ladder embodiment is illustrated. It should be understood that other types of ladders, such as those having safety structures including a platform or gate, may incorporate the inventive structure. Moreover, the ladder may be formed of wood, any suitable metal, or any other appropriate material.

A preferred embodiment of the present invention has been disclosed, however, a worker or ordinary skill in the art would recognize that certain modifications would come within the scope of this invention. For that reason the following claims should be studied in order to determine the true scope and content of this invention.

What is claimed is:

1. A ladder system for positioning a ladder between two spaced storage areas which are positioned on a floor, a longitudinal direction being defined as extending parallel to the spaced storage areas, a lateral direction being defined as extending between said spaced storage areas, the ladder system comprising:

a ladder adapted to contact the floor;

a track system adapted to be attached to at least one storage area, said ladder being mounted on said track system for selective movement along said longitudinal direction only, along said lateral direction only, and along both said longitudinal direction and said lateral direction simultaneously, said track system including a first guide track and a second guide track, said guide tracks each extending along a longitudinal axis, said track system further including a first rod extending along a lateral axis between said guide tracks, said first rod being coupled to said first and second guide tracks for longitudinal movement along said guide tracks;

a pair of spaced rollers attached to said ladder for coupling said ladder to said first rod, said rollers being spaced apart at a distance that is generally the diameter of said first rod, said first rod being interposed between said pair of rollers, said rollers cooperatively gripping said first rod and guiding said ladder for lateral and pivoting movement relative to said first rod, said ladder being movable laterally between said first and second guide tracks, and said ladder being adapted to pivot about said lateral axis of said first rod; a pair of laterally spaced sidewalls, one of said guide tracks being associated with one of said sidewalls, said first rod being rigidly secured to said sidewalls and extending between said sidewalls; and a second rod rigidly secured to said sidewalls and extending between said sidewalls for providing increased stability.

2. A ladder system as recited in claim 1, wherein a second pair of said rollers are spaced along said first rod in said lateral direction for guiding said ladder.

3. A ladder system as recited in claim 1, wherein said pair of rollers have curved surfaces received on said first rod corresponding to the outer periphery of a cross section of said first rod such that said rollers may pivot about said first rod.

4. A ladder system for use with a pair of laterally spaced storage areas, a longitudinal direction being defined as extending parallel to the spaced storage areas and a lateral direction being defined as extending between the spaced storage areas, the ladder system comprising:

a pair of spaced storage areas with a central aisle laterally between said storage areas, said central aisle having a floor;

a ladder received in said aisle and adapted to contact the floor;

a first guide track and a second guide track, one of said guide tracks extending longitudinally along each of said spaced storage areas, said ladder being mounted for longitudinal movement along both of said guide tracks and for stopping at any location along said guide tracks, said ladder being also mounted for lateral movement between said spaced storage areas at said any location;

a first rod extending along a lateral axis, said first rod being coupled to said first and second guide tracks for longitudinal movement along said guide tracks;

a pair of spaced rollers attached to said ladder for coupling said ladder to said first rod, said ladder being movable laterally along said first rod between said first and second guide tracks, said rollers being spaced apart at a distance that is generally the diameter of said first rod, said first rod being interposed between said pair of rollers, said rollers cooperatively gripping said first rod and guiding said ladder for lateral and pivoting movement;

a pair of laterally spaced sidewalls, one of said guide tracks being associated with one of said sidewalls, said first rod being rigidly secured to said sidewalls and extending between said sidewalls; and a second rod rigidly secured to said sidewalls and extending between said sidewalls providing increased stability.

5. A ladder system as recited in claim 4, wherein said pair of rollers have curved surfaces received on said first rod corresponding to the outer periphery of a cross section of said first rod such that said rollers may pivot about said first rod.

* * * * *